US009980328B1

(12) United States Patent
Mays, II

(10) Patent No.: US 9,980,328 B1
(45) Date of Patent: May 22, 2018

(54) APPARATUS, SYSTEM, AND METHOD FOR CONFIGURING AN UNPOWERED LED DRIVER USING AN RS-232 INTERFACE

(71) Applicant: Universal Lighting Technologies, Inc., Madison, AL (US)

(72) Inventor: Stephen D. Mays, II, Madison, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 0 days. days.

(21) Appl. No.: 15/710,922

(22) Filed: Sep. 21, 2017

Related U.S. Application Data

(60) Provisional application No. 62/397,401, filed on Sep. 21, 2016.

(51) Int. Cl.
*H05B 33/08* (2006.01)

(52) U.S. Cl.
CPC ..... *H05B 33/0809* (2013.01)

(58) Field of Classification Search
CPC ..... H05B 37/02; H05B 37/0227; H05B 37/0272; H05B 33/08; H05B 33/0809; H05B 33/0815; H05B 33/0887
USPC ..... 315/185 R, 186, 291, 307, 308, 312
See application file for complete search history.

(56) References Cited

U.S. PATENT DOCUMENTS

2013/0193879 A1* 8/2013 Sadwick ..... H05B 33/0818 315/307

* cited by examiner

*Primary Examiner* — Jimmy Vu
(74) *Attorney, Agent, or Firm* — Patterson Intellectual Property Law, P.C.; Gary L. Montle

(57) ABSTRACT

Systems, methods and apparatuses for configuring an unpowered light emitting diode (LED) driver using an RS-232 interface are provided. An LED driver includes an RS-232 serial connector and an RS-232 serial interface controller coupled to the RS-232 serial connector. The RS-232 serial interface controller is configured to provide an RS-232 port for the LED driver. The LED driver includes a voltage regulator coupled between the RS-232 serial connector and the RS-232 serial interface controller. The voltage regulator is configured (i) to receive a voltage regulator input voltage at least in part from the RS-232 serial connector when operating in an unpowered tuning mode, and (ii) to output a regulated voltage. A controller of the LED driver is powered by the regulated voltage during an unpowered tuning operation of the LED driver.

20 Claims, 6 Drawing Sheets

APPARATUS, SYSTEM, AND METHOD FOR CONFIGURING AN UNPOWERED LED DRIVER USING AN RS-232 INTERFACE

CROSS-REFERENCES TO RELATED APPLICATIONS

This application claims benefit of U.S. Provisional Patent Application No. 62/397,401, dated Sep. 21, 2016, entitled "Apparatus and Method for Configuring an Unpowered LED Driver Using an RS232 Interface," and which is hereby incorporated by reference in its entirety.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to apparatuses, systems, and methods for configuring an unpowered light emitting diode (LED) driver using an RS-232 interface.

Many luminaire manufacturers desire to configure LED drivers before shipping to customers for installation without being coupled to a mains power source. Existing methods for unpowered configuration of LED drivers include Multi-Driver Configuration (MDC) and Radio Frequency Identification (RFID) technology.

LED Drivers employing MDC require a direct current (DC) blocking capacitor, an isolation transformer, and sensing circuitry, which adds significant cost to an LED driver. Furthermore, to use the MDC interface, a special configuration tool capable of developing and interpreting the MDC signals must be used. Both MDC and RFID also require extra and often costly circuitry.

LED Drivers employing RFID technology require an antenna and a tag emulator integrated circuit (IC) containing a non-volatile memory space, the temperature rating of which is typically not appropriate for commercial lighting. RFID technology increases cost and decreases the reliability of LED drivers. Much like MDC circuitry, a special configuration tool is also required to configure the LED driver via RFID.

BRIEF SUMMARY OF THE INVENTION

It is thus desirable to provide the ability to configure an unpowered light emitting diode (LED) driver via an inexpensive serial interface, such as RS-232, while also providing sufficient operating power the necessary circuitry of the LED driver to permit configuration.

The equipment required to configure an LED driver according to the present disclosure may be a simple RS-232 port commonly found in inexpensive computers. Simple RS-232 ports can be purchased as powered and accessed via a universal serial bus (USB) port. Software on a host computer for configuring an LED driver may be simplified as compared to a traditional communication (COM) port, thereby eliminating the requirement for complicated and potentially expensive universal serial bus (USB) drivers.

One object of the systems and methods disclosed herein is to provide a light emitting diode (LED) driver for permitting unpowered tuning. The LED driver includes an RS-232 serial connector and an RS-232 serial interface controller coupled to the RS-232 serial connector. The RS-232 serial interface controller includes a serial received voltage input coupled to the RS-232 serial connector and a serial transmit voltage output coupled to the RS-232 serial connector. The RS-232 serial interface controller is configured to provide an RS-232 port for the LED driver. The LED driver further includes a voltage regulator coupled between the RS-232 serial connector and the RS-232 serial interface controller. The voltage regulator is configured (i) to receive a voltage regulator input voltage at least in part from the RS-232 serial connector when operating in an unpowered tuning mode, and (ii) to output a regulated voltage. The LED driver further includes a controller having a controller received voltage input and a controller transmit voltage output, each coupled to the RS-232 serial interface controller. The controller is powered by the regulated voltage during an unpowered tuning operation.

Another aspect of the systems and methods disclosed herein is a method for providing unpowered tuning of a light emitting diode (LED) driver. The method begins by receiving at least one RS-232 serial communication from a host computer at the LED driver. The received at least one RS-232 serial communication is provided to both an RS-232 serial port and to a voltage regulator of the LED driver. Operations of the LED driver are powered by an output of the voltage regulator. The at least one RS-232 serial communication is interpreted to determine a parameter associated with the LED driver. At least one operation is then performed based at least in part upon the determined parameter.

A further aspect of the present invention is a system for providing unpowered tuning of a light emitting diode (LED) driver via an RS-232 serial interface. The system includes a serial cable having a first serial coupler and a second serial coupler. The system further includes a host computer having a serial output port configured to transmit at least one serial communication via the first serial coupler of the serial cable. The LED driver includes an RS-232 serial connector coupleable to the host computer via the second serial coupler of the serial cable. The LED driver further includes an RS-232 serial interface controller coupled to the RS-232 serial connector, the RS-232 serial interface controller including a serial received voltage input coupled to the RS-232 serial connector and a serial transmit voltage output coupled to the RS-232 serial connector. The RS-232 serial interface controller is configured to provide an RS-232 port for the LED driver. The LED driver further includes a voltage regulator coupled between the RS-232 serial connector and the RS-232 serial interface controller, the voltage regulator configured (i) to receive a voltage regulator input voltage at least in part from the RS-232 serial connector when operating in an unpowered tuning mode, and (ii) to output a regulated voltage. The LED driver further includes a controller having a received controller voltage input and a transmit controller voltage output each coupled to the RS-232 serial interface controller, the controller configured to be powered by the regulated voltage during an unpowered tuning operation.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
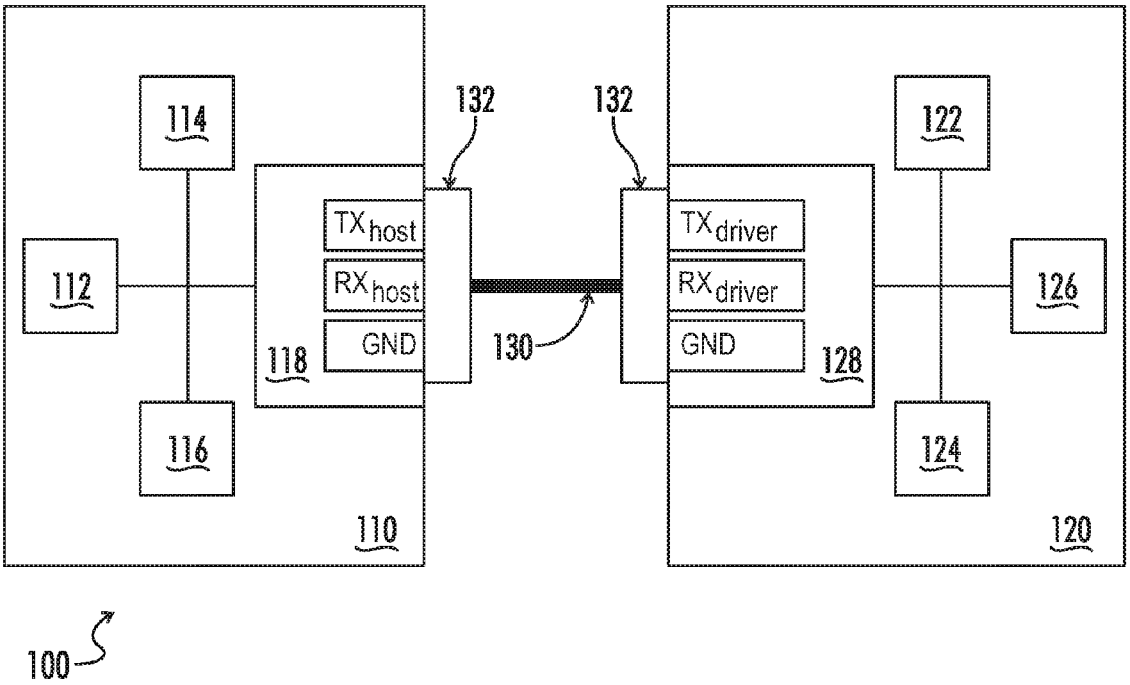
FIG. 1 illustrates a block diagram of an exemplary embodiment of an unpowered tuning system for a light emitting diode (LED) luminaire according to aspects of the present disclosure.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-8, an exemplary apparatuses, systems, and methods for configuring an unpowered LED driver using an RS-232 interface are provided. Where the various figures may describe embodiments sharing various common elements and features with other embodiments, similar elements and features are given the same reference numerals and redundant description thereof may be omitted below.

FIG. 1 illustrates a block diagram of an exemplary embodiment of an unpowered tuning system for a light emitting diode (LED) luminaire according to aspects of the present disclosure. As used herein, the term unpowered may refer to a situation where input power is not received via a mains power input. The unpowered tuning system 100 includes a host computer 110 and a driver 120. The host computer 110 includes at least one of a processor 112, a memory 114, a display section 116, and/or a communication interface 118. The host computer 110 may be configured to provide at least one configuration and/or tuning signal to the driver 120. The host computer 110 may generate and/or transmit the at least one configuration and/or tuning signal according to one or more operations of the processor 112. In one exemplary operation, the host computer 110 is configured to store one or more sets of instructions in the memory 114, which are configured to be executed by the processor 112 to perform operations corresponding to the one or more sets of instructions. A display section 116 is associated with the host computer 110 in one embodiment, and is configured to be either wired or wirelessly-interfaced with the host computer 110.

In various exemplary embodiments, the host computer 110 may be at least one of a desktop computer, a laptop computer, a smart phone, or any other electronic device capable of executing instructions. The processor 112 may be a generic hardware processor, a special-purpose hardware processor, a programmable logic array, a software processor, or any combination thereof. In embodiments having a generic hardware processor (e.g., as a central processing unit (CPU) available from manufacturers such as Intel and AMD), the generic hardware processor is configured to be converted to a special-purpose processor by means of being programmed to execute and/or by executing a particular algorithm in the manner discussed herein for providing a specific operation or result.

The host computer 110 is configured in various embodiments to be associated with a fixed location, but is also capable of being transported, either during operation or while powered off. In various embodiments, the host computer 110 may be configured to operate remotely from a location of the driver 120 and may be configured to obtain or otherwise operate upon one or more instructions stored physically remote from the host computer 110 (e.g., via client-server communications and/or cloud-based computing). The host computer 110 may be configured to provide one or more configuration and/or tuning signals to the driver 120 automatically or at least in part in response to an operation of a user of the host computer 110. For example, a user of the host computer 110 may select a particular configuration parameter or group of parameters to be transmitted to at least one driver 120 from the host computer 110 via the communication interface 118. The host computer may be configured to store one or more configuration profiles, at least one of the one or more configuration profiles being associated with an LED driver. The host computer may be further configured to transmit the at least one of the one or more configuration profiles to the LED driver via an RS-232 port.

The communication interface 118 of the host computer 110 may include a serial communication port coupled to or otherwise associated with a serial connector capable of transmitting and/or receiving one or more signals. The communication interface 118 may include a host RS-232 port coupled to an RS-232 connector in various exemplary embodiments. The host RS-232 port may include a transmit port $TX_{host}$, a receive port $RX_{host}$, and/or a ground port GND. The serial connector of the communication interface 118 may include one or more conductive pins or other electrical conveyance elements associated with one or more of the transmit port $TX_{host}$, the receive port $RX_{host}$, and/or the ground port GND. The communication interface 118 may be communicatively coupled to a cable 130 via at least one cable connector 132. One or more of the at least one cable connector 132 may be configured to couple to or otherwise communicate using the communication interface 118. For example, the at least one cable connector 132 may be a male or female RS-232 connector, a USB connector, or the like. The cable 130 may be coupleable to the host computer 110 via at one or more of the at least one cable connector 132.

The driver 120 may include at least one of a processor 122, a memory 124, a component 126, and/or a communication interface 128. At least a portion of the driver 120 may be housed within an LED luminaire in various embodiments. The driver 120 may be configured to receive at least one configuration and/or tuning signal from the host computer 110 and/or to transmit at least one set of data to the driver 120 using the communication interface 128.

Like the communication interface 118 of the host computer 110, the communication interface 128 of the driver 120 may include a serial communication port coupled to or otherwise associated with a serial connector capable of transmitting and/or receiving one or more signals. The communication interface 128 may include a driver RS-232 port coupled to an RS-232 connector in various exemplary embodiments. The driver RS-232 port may include a transmit port $TX_{driver}$, a receive port $RX_{driver}$, and/or a ground port GND. The serial connector of the communication interface 128 may include one or more conductive pins or other electrical conveyance elements associated with one or more of the transmit port $TX_{driver}$, the receive port $RX_{driver}$, and/or the ground port GND. The communication interface 128 may be communicatively coupled to a cable 130 via at least one cable connector 132. One or more cable connector 132 may be configured to couple to or otherwise communicate using the communication interface 128. For example, the at least one cable connector 132 may be a male or female RS-232 connector. The cable 130 may be coupleable to the driver 120 via one or more cable connector 132.

When connected to one another via the cable 130 in one exemplary embodiment, the transport port $TX_{host}$ of the host computer 110 may be communicatively coupled to the receive port $RX_{driver}$ of the driver 120 and the receive port $RX_{host}$ of the host computer 110 may be communicatively coupled to the transmit port $TX_{driver}$ of the driver 120.

The processor 122 may be a generic hardware processor, a special-purpose hardware processor, a programmable logic array, a software processor, or any combination thereof. In embodiments having a generic hardware processor (e.g., as a central processing unit (CPU) available from manufacturers such as Intel and AMD), the generic hardware processor is configured to be converted to a special-purpose processor by means of being programmed to execute and/or by executing a particular algorithm in the manner discussed herein for providing a specific operation or result. In one exemplary operation, the driver 120 is configured to store one or more sets of instructions in the memory 124, which are configured to be executed by the processor 122 to perform operations corresponding to the one or more sets of instructions. The processor 122 may be configured to interpret one or more received configuration parameters and to optionally perform at least one operation corresponding to the one or more received configuration parameters. For example, in one embodiment, the processor 122 is configured to interpret a received configuration and/or tuning parameter associated with the driver 120 and to implement the received configuration and/or tuning parameter at the driver 120.

The driver 120 may include at least one component 126. The at least one component 126 may include, for example, one or more circuits or logic units configured to perform one or more operations or to assist in performing one or more operations of the driver 120. In various exemplary embodiments, the at least one component 126 may include one or more of the sections, configurations, and systems illustrated by and described with reference to FIGS. 2-8, such as the serial input section, the driver voltage regulation section, the internal driver power section, the controller configuration, the serial interface controller configuration, and/or the exemplary embodiment illustrated by FIG. 7.

Figure 2:
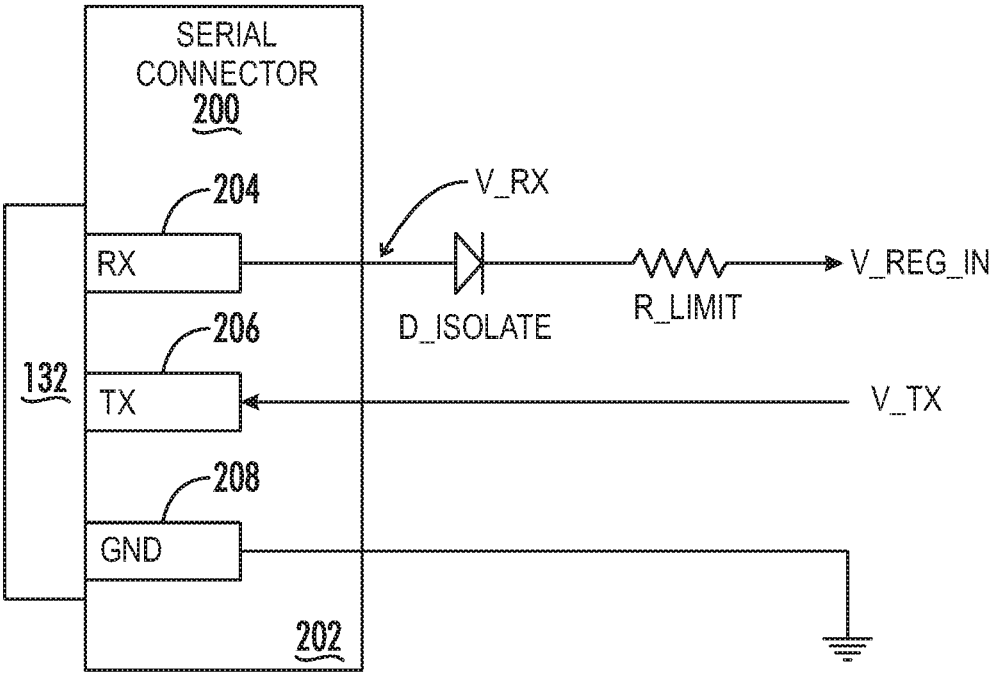
FIG. 2 illustrates an exemplary embodiment of a serial input section of an LED driver according to aspects of the present disclosure.

FIG. 2 illustrates an exemplary embodiment of a serial input section of an LED driver according to aspects of the present disclosure. The serial input section includes a serial connector 200 having one or more of a receive pin RX 204, a transmit pin TX 206, and/or a ground pin GND 208 associated with the communication interface 128 of the driver 120. The serial connector 200 may include one or more serial communication elements configured to send and/or receive data. The serial connector 200 may be configured to receive one or more sets of data, for example from a cable 130 via a connector 132 as illustrated by FIG. 1.

The receive pin RX 204 may be configured to receive one or more sets of data. The one or more sets of data may be provided to an anode of an isolation diode D—ISOLATE. The isolation diode D—ISOLATE may be configured in one exemplary embodiment to both isolate data transmitted from a host computer 110 from a voltage regulator (e.g., voltage regulator 300 as illustrated by and described below with reference to FIG. 3) and to isolate current available from an internal power supply (e.g., internal power circuit 710 as illustrated by and described below with reference to FIG. 7) and/or available from a serial port (e.g., RS-232 or the like) of the host computer 110. A current limiting resistor R_LIMIT may be coupled to the cathode of the isolation diode D_ISOLATE. The current limiting resistor R_LIMIT may be configured to limit a current received by a charging capacitor C_BANK, for example when the LED driver is first powered via the serial port. The capacitor C_BANK may be configured to store sufficient charge to maintain the voltage regulator 300 in an active state when a series of zeroes are received at the LED driver's serial connector 200.

The transmit pin TX 206 may be configured to transmit a voltage V_TX (e.g., received from a serial interface controller 600 as illustrated by and as described below with reference to FIG. 6). The serial connector 200 may be connected to ground via a ground pin GND 208. In various exemplary embodiments, each of the receive pin RX 204, the transmit pin TX 206, and/or the ground pin GND 208 may be implemented using one or more conductive pins or other conductive materials.

Figure 3:
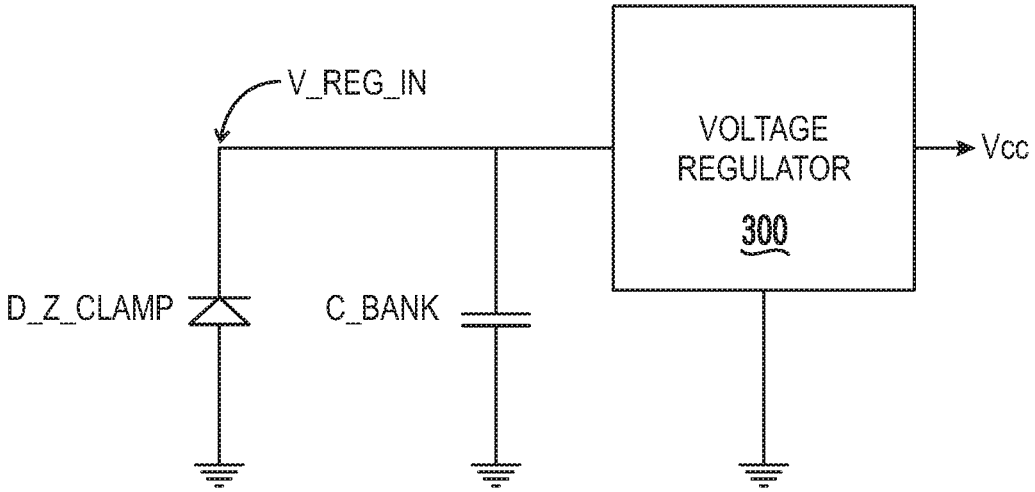
FIG. 3 illustrates a partial circuit schematic of an exemplary embodiment of a driver voltage regulation section according to aspects of the present disclosure.

FIG. 3 illustrates a partial circuit schematic of an exemplary embodiment of a driver voltage regulation section according to aspects of the present disclosure. The driver voltage regulation section includes a node corresponding to a voltage regulator received voltage V_REG_IN. The node corresponding to the received voltage V_RX may be coupled to each of the cathode of a clamping diode D_Z_CLAMP, to a first end of a capacitor C_BANK, and to a voltage regulator 300. The anode of the clamping diode D_Z_CLAMP may be coupled to ground. A second end of the capacitor C_BANK may be coupled to ground. The voltage regulator 300 may also be coupled to ground, may be configured to perform one or more voltage regulation operations on a received signal and may be configured to output a voltage Vcc.

Figure 4:
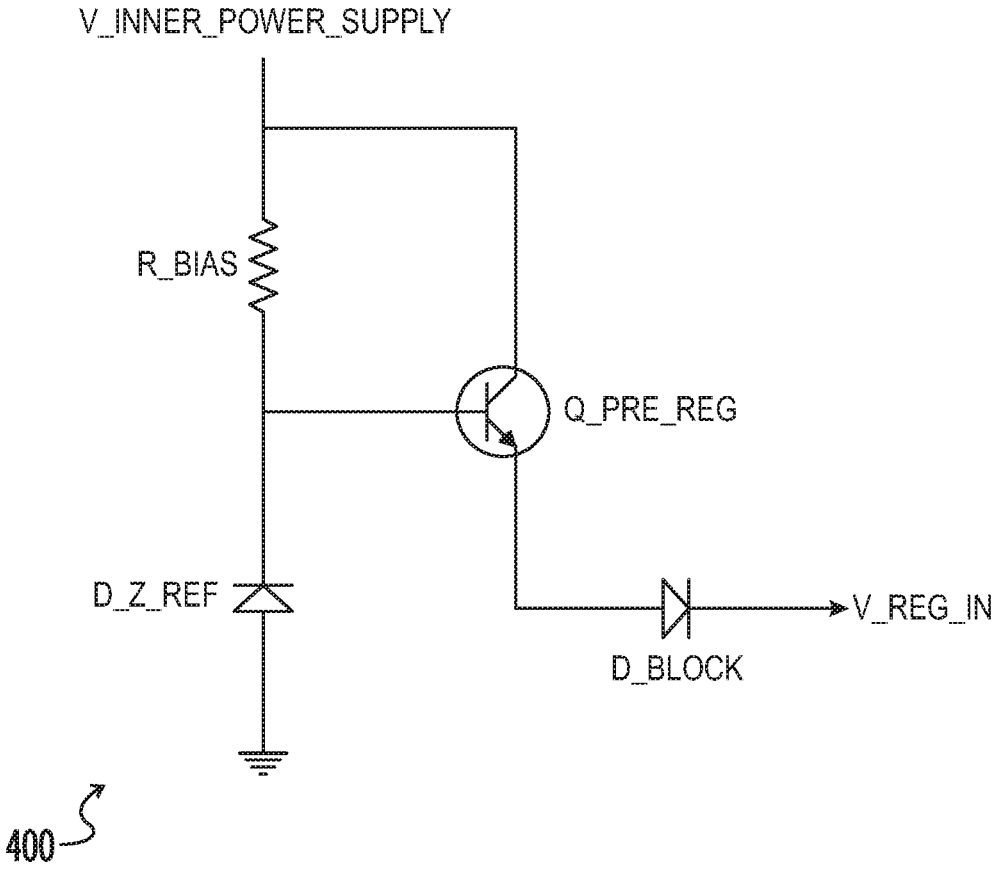
FIG. 4 illustrates a partial circuit schematic of an exemplary embodiment of an internal driver power section according to aspects of the present disclosure.

FIG. 4 illustrates a partial circuit schematic of an exemplary embodiment of an internal driver power section according to aspects of the present disclosure. The internal driver power section 400 is configured to receive an input voltage V_INNER_POWER_SUPPLY from an internal power supply or power source associated with the driver 120 (e.g., from internal power supply 720). Additionally or alternatively, the internal driver power section 400 may include one or more components of an internal power supply or power source which is configured to provide operating power to at least a portion of the driver 120. The voltage V_INNER_POWER_SUPPLY may be generated by the internal power supply or power source from a mains voltage received by the driver 120. For example, the voltage V_INNER_POWER_SUPPLY may be generated by an internal power supply of the driver 120 when the internal power supply is coupled to an alternating current (AC) mains input, a direct current (DC) input, or any other power input.

When a mains input power is available, the voltage V_INNER_POWER_SUPPLY may be used to supply operating power to the voltage regulator 300 via a pre-regulator section having one or more of a bias resistor R_BIAS, a reference diode D_Z_REF, and a pre-regulator transistor Q_PRE_REG. The reference diode D_Z_REF may be a Zener diode in one or more embodiments. The pre-regulator transistor Q_PRE_REG may be an NPN bipolar transistor in an exemplary embodiment, although any type of transistor may be used within the scope of the present disclosure. The pre-regulator section may not be necessary in one or more implementations where the voltage regulator 300 can withstand the magnitude of V_INNER_POWER_SUPPLY. The pre-regulator section may further include a blocking diode D_BLOCK which is configured to prevent current from a serial port of the host computer 110 from being sunk by the pre-regulator section. A voltage regulator input voltage V_REG_IN may be output from the internal driver power section 400.

Figure 5:
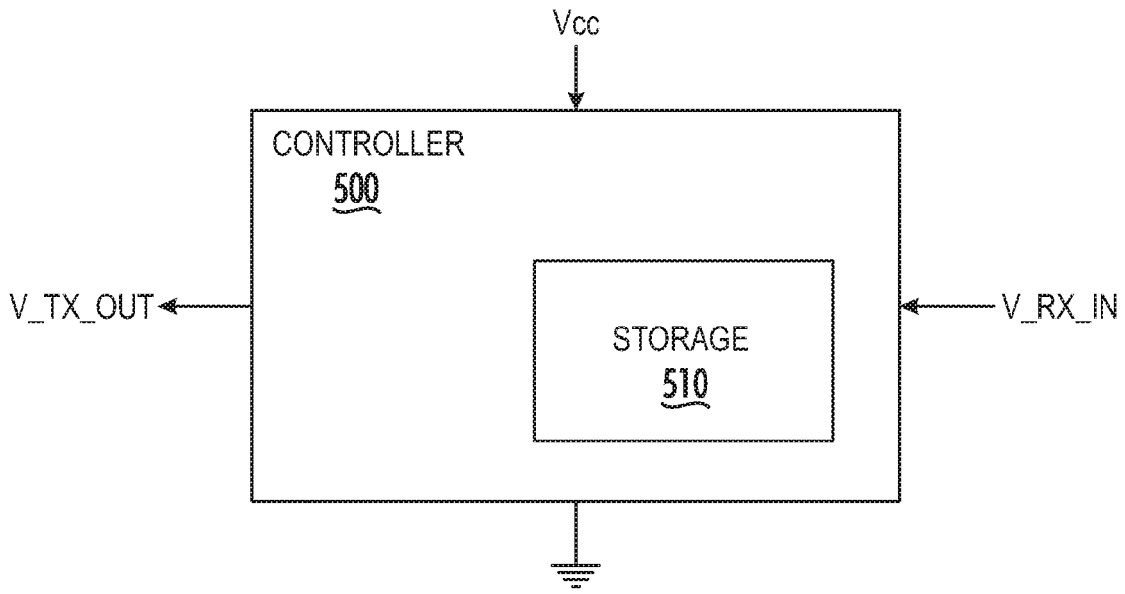
FIG. 5 illustrates a block diagram of a controller configuration according to aspects of the present disclosure.

FIG. 5 illustrates a block diagram of a controller configuration according to aspects of the present disclosure. A controller 500 may be configured to receive an input voltage V_RX_IN and to transmit an output voltage V_TX_OUT. The controller 500 may be configured to receive an input voltage Vcc and may be coupled to ground. The controller 500 may be configured to control one or more operations of the driver 120. The controller 500 may include a storage 510 configured to store one or more instructions or sets of data for use by or in association with the controller 500. Additionally or alternatively, at least a portion of the storage 510 may be located remotely from the controller 500, either within or outside of the driver 120 in various embodiments. The storage 510 is configured in an exemplary embodiment to store one or more configuration parameters received from the host computer 110.

Figure 6:
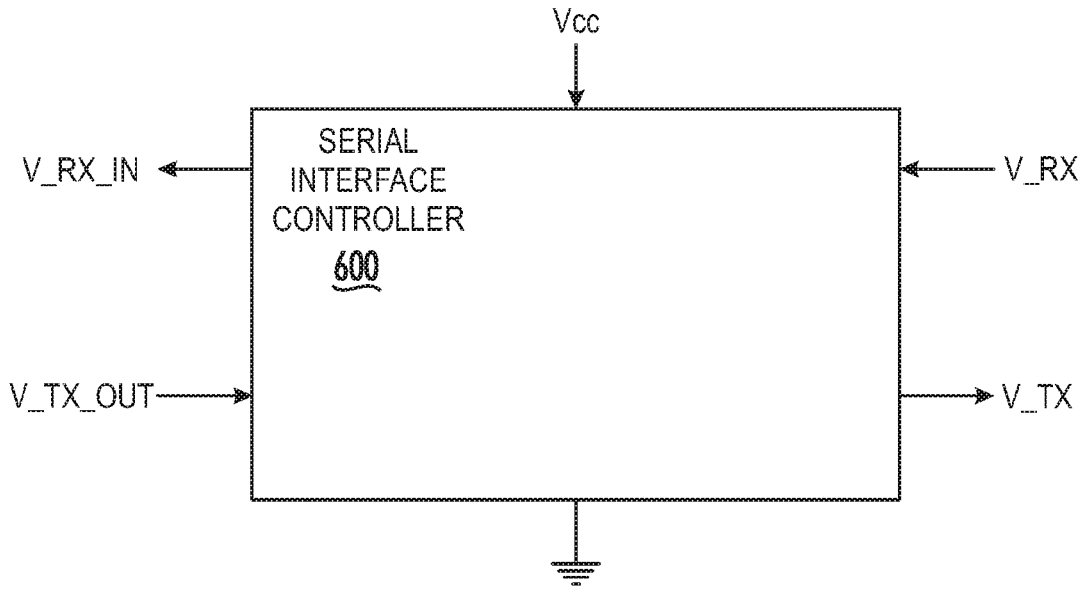
FIG. 6 illustrates a block diagram of a serial interface controller according to aspects of the present disclosure.

FIG. 6 illustrates a block diagram of a serial interface controller according to aspects of the present disclosure. The serial interface controller 600 may be configured to receive the voltage V_RX corresponding to the voltage received at the serial connector 200 of the driver 120 and to output an output voltage V_TX via the serial connector 200. The serial connector 200 may be configured to perform one or more operations for providing a serial port at the driver 120. The serial interface controller 600 may be further configured to output a received input voltage V_RX_IN to the controller 500 and to receive a transmitted output voltage V_TX_OUT from the controller 500. The serial interface controller 600 may be configured to receive a supply voltage Vcc and may be further coupled to ground. The serial interface controller 600 may be configured to receive a representation of a serial signal received at the serial connector 200 via V_RX and to optionally provide a corresponding received input voltage V_RX_IN to the controller 500. The serial interface controller 600 may be further configured to receive an output transmit voltage V_TX_OUT from the controller 500 and to optionally transmit a corresponding transmit voltage V_TX to the serial connector 200 for output to the host computer 110.

The serial interface controller 600 may be configured to interpret one or more signals received from the serial connector 200 and to provide at least a representation of the interpreted signal(s) to the controller 500. The controller 500 may then perform one or more operations in the manner previously described herein. The serial interface controller 600 may be implemented as an RS-232 serial interface controller in one exemplary embodiment (e.g., as an RS-232 integrated circuit (IC)). Additionally or alternatively, the serial interface controller 600 may be configured to operate in accordance with a plurality of serial communication formats or protocols (e.g., RS-232, RS-422/RS-485, USB, etc.). In one or more embodiments, one or more operations associated with the serial interface controller 600 may be implemented by the controller 500, either in whole or in part, without departing from the spirit and the scope of the present disclosure. Furthermore, one or more of the controller 500, the serial interface controller 600, or any portion thereof may be located within the driver 120, external to the driver 120, or any combination thereof.

Figure 7:
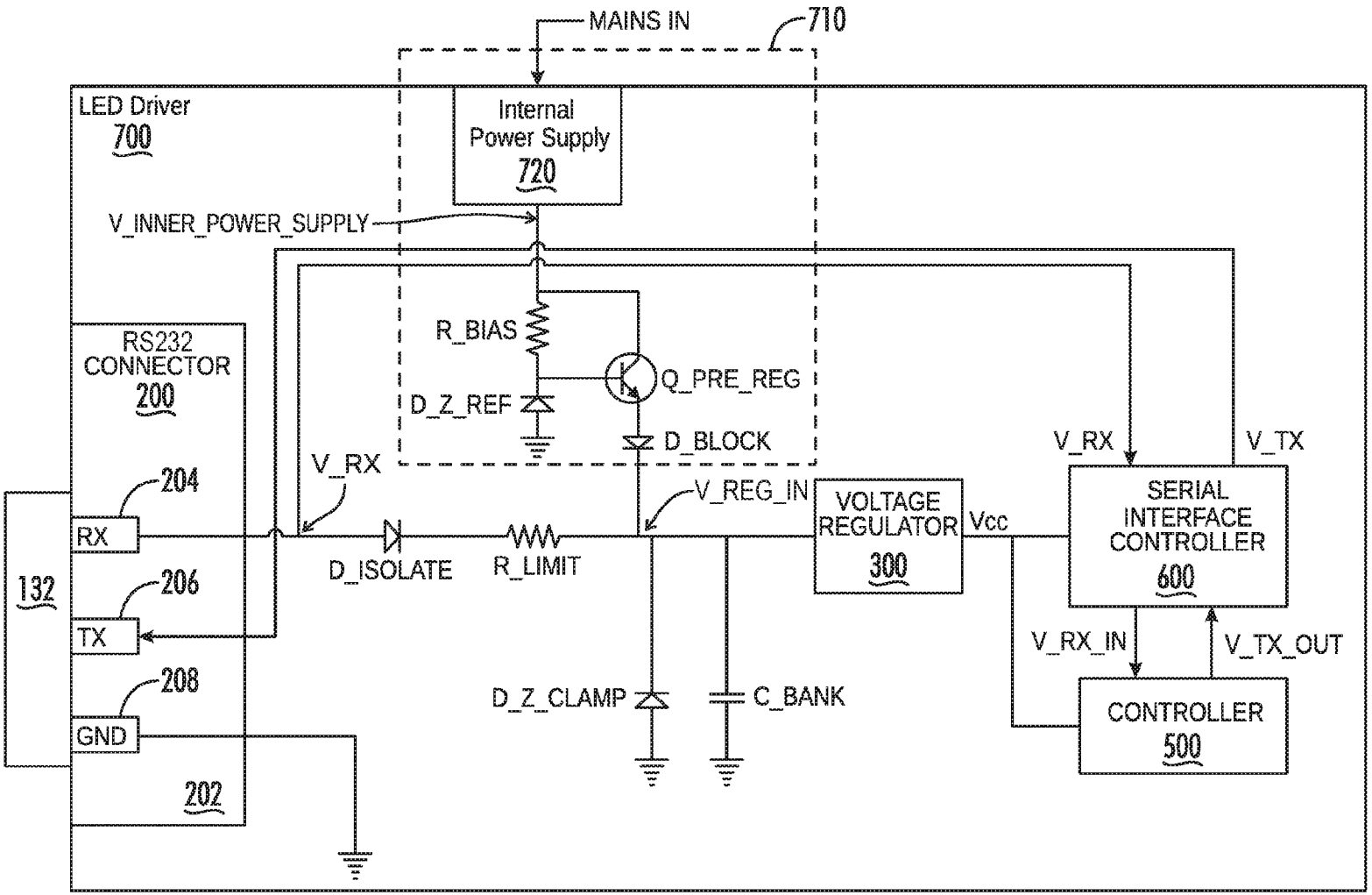
FIG. 7 illustrates a partial circuit schematic of an exemplary embodiment of an LED driver according to aspects of the present disclosure.

FIG. 7 illustrates a partial circuit schematic of an exemplary embodiment of an LED driver 700 according to aspects of the present disclosure. The LED driver 700 is configured to operate at least one of in an internally-powered mode and an unpowered mode. In an internally-powered mode, the LED driver 700 is configured to receive operating power from an internal power circuit 710. In an unpowered mode, the LED driver 700 is configured to receive both operating power and at least one tuning parameter or configuration from an external source at the serial connector 200 and to perform at least one corresponding operation without the LED driver 700 being powered by the internal power circuit 710.

The internal power circuit 710 includes an internal power supply 720 and components of the internal driver power section 400. As such, the internal power circuit 710 includes one or more of the bias resistor R_BIAS, the reference diode D_Z_REF, the pre-regulator transistor Q_PRE_REG, and/or the blocking diode D_BLOCK.

The LED driver 700 includes an RS-232 port implemented by the serial interface controller 600 coupled to an RS-232 connector in the exemplary embodiment of FIG. 7. The serial connector 200 is configured to receive a serial input signal from an external computer 110 via a connector 132. The serial interface controller 600 is coupled to the transmit pin TX 204 and to the receive pin RX 206 of the serial connector 200 via a conductive bus and is configured to thereby respectively receive the voltage V_RX from the serial connector 200 and to transmit the voltage V_TX to the serial connector 200. The serial interface controller 600 is implemented as an RS-232 interface controller in the exemplary embodiment of FIG. 7. The voltage V_RX received at the receive pin 204 is provided to the anode of the isolation diode D_ISOLATE and is configured to pass from the cathode of the isolation diode D_ISOLATE through the current limiting resistor R_LIMIT.

An output of the current limiting resistor R_LIMIT corresponding to the voltage V_RX and an output of the internal power circuit 710 is represented by the voltage regulator input voltage V_REG_IN. The voltage regulator input voltage V_REG_IN is coupled to the clamping diode D_Z_CLAMP, the capacitor C_BANK, and the voltage regulator 300 in the exemplary embodiment of FIG. 7. The voltage regulator 300 provides an output voltage Vcc to the controller 500 and to the serial interface controller 600.

During operation, when mains power is provided to the internal power circuit 710, the controller 500 and the serial interface controller 600 of the LED driver 700 may be powered via V_INNER_POWER_SUPPLY output of the internal power supply 720 and the LED driver 700 may communicate with the host computer 110 via the connector 132 of the cable 130. Communications from the LED driver 700 to the host computer 110 via serial port may include transferring data relating to at least one of telemetry data, dimming data, and configuration data relating to the LED driver 700.

Most luminaire manufacturers prefer to configure LED drivers before shipping to customers for installation without being coupled to a mains power source. When not coupled to a mains power source, the voltage V_INNER_POWER_SUPPLY is unavailable, thereby preventing unpowered luminaire factory configuration.

Unlike existing LED driver configuration systems, implementations consistent with the present disclosure may be configured to harvest power from a serial output port of the host computer 110 to power the controller 500 and the serial interface controller 600 when mains power is not provided to the internal power supply 720 (and thus V_INNER_POWER_SUPPLY is not available). Although there is no standard for RS-232 signals, the vast majority of the time the TX port remains at a high voltage during operation. As such, power may be harvested using the high voltage received from the serial TX port of a host computer 110.

The voltage regulator 300 is protected in the exemplary embodiment of FIG. 7 by the clamping diode D_Z_CLAMP from abnormally high serial port voltages and possible electrostatic discharge (ESD)-related surges that may occur when the LED driver 700 is first coupled to a serial port of the host computer 110. The current limiting resistor R_LIMIT may be configured limit current sunk by the clamping diode D_Z_CLAMP.

Figure 8:
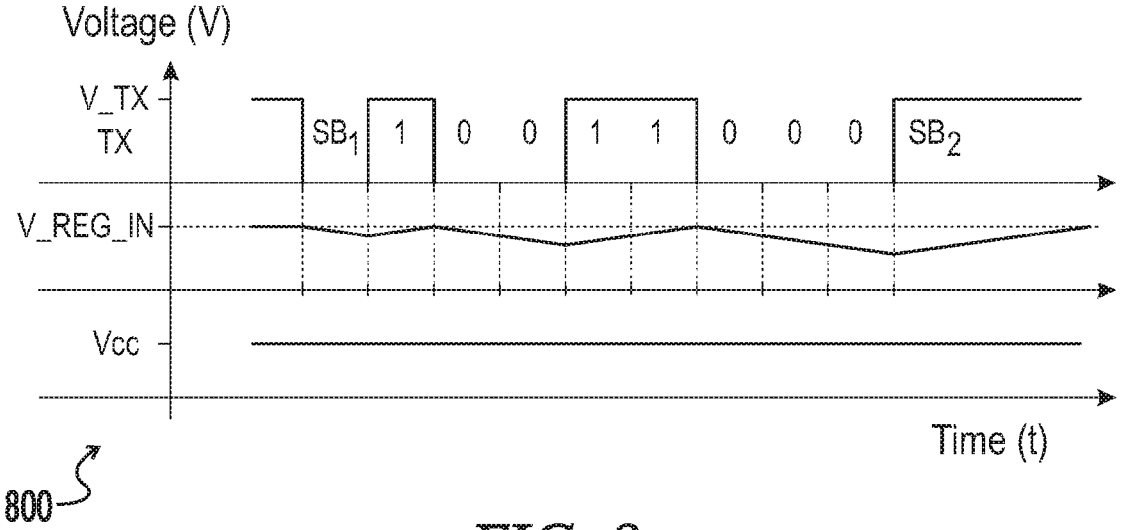
FIG. 8 illustrates a timing diagram reflecting a relationship between voltages of an LED driver according to an exemplary embodiment.

FIG. 8 illustrates a timing diagram reflecting a relationship between the various voltages of an LED driver according to an exemplary embodiment. The timing diagram 800 includes graphs of the voltages V_TX of the transmit port TX of the host computer 110, the voltage regulator input voltage V_REG_IN, and the voltage Vcc over time according to an exemplary serial information signal. The information signal illustrated by FIG. 8 may include at least one start bit $SB_1$, one or more information bits (illustrated as being either '0' or '1' in FIG. 8), and at least one stop bit $SB_2$. During operation, the transmit voltage V_TX output by the host computer 110 serial port may remain high ('1') when not transmitting an information signal. Thus, power may be supplied from the host computer 110 to an LED driver (such as LED driver 700) while the host computer 110 is coupled to the LED driver via a cable 130. The voltage V_TX may be held low ('0') for one or more consecutive bits to form a start bit $SB_1$ indicating information bits will follow the start bit(s) $SB_1$. The serial port of the LED driver may recognize the start bit configuration and receive one or more following information bits (e.g., using at least one of the serial interface controller 600 and/or the controller 500). One or more stop bits $SB_2$ may be used to indicate the end of a sequence of information bits and may be recognized to by the LED driver in a similar manner to that of recognizing one or more start bits $SB_1$.

One or more sets of information bits received at the LED driver from the host computer 110 may correspond to at least one of a configuration and/or tuning parameter associated with the LED driver in various exemplary embodiments. As previously described, the host computer 110 may be configured to transmit one or more configurations and/or parameters to the LED driver in an unpowered mode when the LED driver is not coupled to a mains power source. During the unpowered mode, the LED driver may be configured to receive sufficient operating power via the serial port connection from the transmit port TX of the serial port of the host computer 110. The LED driver may be further configured to be additionally or alternatively powered by a mains power input during at least one of a configuration process and/or a standard operating condition as previously described.

The voltage regulator input voltage V_REG_IN may be configured to rise when the voltage V_TX is high and to drop when the voltage V_TX is low in an unpowered configuration or tuning mode, as illustrated by FIG. 8. The output voltage Vcc of the voltage regulator 300 may be a constant voltage value in the exemplary embodiment illustrated by FIG. 8.

Implementations consistent with the present disclosure offer numerous advantages to existing LED driver configuration systems. For example, a simple, traditional serial port such as an RS-232 port may be all that is required to both power and to communicate with an LED driver for an unpowered configuration. Furthermore, implementations consistent with the present disclosure may use only inexpensive hardware, such as diodes, resistors, and capacitors to accomplish one or more of the described circuit(s) and corresponding operations relating to power harvesting via a port of the serial transceiver.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A light emitting diode (LED) driver for permitting unpowered tuning, comprising:

an RS-232 serial connector;

an RS-232 serial interface controller coupled to the RS-232 serial connector, the RS-232 serial interface controller including a serial received voltage input coupled to the RS-232 serial connector and a serial transmit voltage output coupled to the RS-232 serial connector, wherein the RS-232 serial interface controller is configured to provide an RS-232 port for the LED driver;

a voltage regulator coupled between the RS-232 serial connector and the RS-232 serial interface controller, the voltage regulator configured (i) to receive a voltage regulator input voltage at least in part from the RS-232 serial connector when operating in an unpowered tuning mode, and (ii) to output a regulated voltage; and a controller including a controller received voltage input and a controller transmit voltage output each coupled to the RS-232 serial interface controller, the controller configured to be powered by the regulated voltage during an unpowered tuning operation.

2. The LED driver of claim 1, further comprising:

an internal power circuit having an internal power supply, the internal power supply being configured to couple to a mains power input and to provide operating power to at least a portion of the LED driver during a powered operating mode.

3. The LED driver of claim 2, wherein the internal power circuit is coupled to the voltage regulator via a common input shared with the RS-232 serial connector as the voltage regulator input voltage.

4. The LED driver of claim 3, further comprising:

a current limiting resistor; and an isolation diode coupled to the RS-232 serial connector at an anode thereof and to the current limiting resistor at a cathode thereof, wherein the isolation diode is configured to isolate an input voltage received at the RS-232 serial connector from a voltage output by the internal power circuit.

5. The LED driver of claim 1, wherein the RS-232 serial interface controller is configured to interpret one or more signals received from the RS-232 serial connector and to provide at least a representation of the interpreted one or more signals to the controller via the controller received voltage input.

6. The LED driver of claim 5, wherein the controller is configured to perform one or more operations based at least in part upon the representation received from the RS-232 serial interface controller.

7. The LED driver of claim 6, wherein the one or more operations includes an unpowered LED driver tuning operation.

8. A method for providing unpowered tuning of a light emitting diode (LED) driver, comprising:

receiving at least one RS-232 serial communication from a host computer at the LED driver;

providing the received at least one RS-232 serial communication to both an RS-232 serial port and to a voltage regulator of the LED driver;

powering operations of the LED driver by an output of the voltage regulator;

interpreting the at least one RS-232 serial communication to determine a parameter associated with the LED driver; and performing at least one operation based at least in part upon the determined parameter.

9. The method of claim 8, wherein the parameter is an LED driver tuning parameter.

10. The method of claim 8, further comprising:

isolating input power received from an external mains power source at an internal power supply of the LED driver from an input signal received at the LED driver.

11. The method of claim 8, wherein the interpreting the at least one RS-232 serial communication comprises:

receiving the at least one RS-232 serial communication at an RS-232 serial port of the LED driver;

determining an output voltage based at least in part upon the received at least one RS-232 serial communication; and transmitting the determined output voltage to a controller of the LED driver.

12. A system for providing unpowered tuning of a light emitting diode (LED) driver via an RS-232 serial interface, the system comprising:

a serial cable having a first serial coupler and a second serial coupler;

a host computer comprising a serial output port configured to transmit at least one serial communication via the first serial coupler of the serial cable; and the LED driver comprising:

an RS-232 serial connector coupleable to the host computer via the second serial coupler of the serial cable;

an RS-232 serial interface controller coupled to the RS-232 serial connector, the RS-232 serial interface controller including a serial received voltage input coupled to the RS-232 serial connector and a serial transmit voltage output coupled to the RS-232 serial connector, wherein the RS-232 serial interface controller is configured to provide an RS-232 port for the LED driver;

a voltage regulator coupled between the RS-232 serial connector and the RS-232 serial interface controller, the voltage regulator configured (i) to receive a voltage regulator input voltage at least in part from the RS-232 serial connector when operating in an unpowered tuning mode, and (ii) to output a regulated voltage; and a controller including a received controller voltage input and a transmit controller voltage output each coupled to the RS-232 serial interface controller, the controller configured to be powered by the regulated voltage during an unpowered tuning operation.

13. The system of claim 12, wherein the first serial coupler is a universal serial bus (USB) connector and the second serial coupler is an RS-232 connector.

14. The system of claim 12, wherein the host computer comprises one or more configuration profiles, at least one of the one or more configuration profiles being associated with the LED driver.

15. The system of claim 14, wherein the host computer is configured to transmit the at least one of the one or more configuration profiles to the LED driver via the RS-232 port.

16. The system of claim 12, wherein the LED driver further comprises:

an internal power circuit having an internal power supply, the internal power supply being configured to couple to a mains power input and to provide operating power to at least a portion of the LED driver during a powered operating mode.

17. The system of claim 16, wherein the internal power circuit is coupled to the voltage regulator via a common input shared with the RS-232 serial connector as the voltage regulator input voltage.

18. The system of claim 17, further comprising:

a current limiting resistor; and an isolation diode coupled to the RS-232 serial connector at an anode thereof and to the current limiting resistor at a cathode thereof, wherein the isolation diode is configured to isolate an input voltage received at the RS-232 serial connector from a voltage output by the internal power circuit.

19. The system of claim 12, wherein the RS-232 serial interface controller is configured to interpret one or more signals received from the RS-232 serial connector and to provide at least a representation of the interpreted one or more signals to the controller via the controller received voltage input.

20. The system of claim 19, wherein the controller is configured to perform one or more operations based at least in part upon the representation received from the RS-232 serial interface controller, the one or more operations including an unpowered LED driver tuning operation.

* * * * *